US010781087B2

(12) United States Patent
Soderberg

(10) Patent No.: US 10,781,087 B2
(45) Date of Patent: Sep. 22, 2020

(54) TRAILER MOUNTED CAPSTAN WINCH

(71) Applicant: Mark S. Soderberg, Conifer, CO (US)

(72) Inventor: Mark S. Soderberg, Conifer, CO (US)

(73) Assignee: Mark S. Soderberg, Conifer, CO (US)

( * ) Notice: Subject to any disclaimer, the term of this patent is extended or adjusted under 35 U.S.C. 154(b) by 0 days.

(21) Appl. No.: 16/201,869

(22) Filed: Nov. 27, 2018

(65) Prior Publication Data

US 2019/0177136 A1 Jun. 13, 2019

Related U.S. Application Data

(60) Provisional application No. 62/564,910, filed on Sep. 28, 2017.

(51) Int. Cl.

| | |
|---|---|
| ***B66D 3/00*** | (2006.01) |
| ***B66D 1/36*** | (2006.01) |
| ***B66D 1/12*** | (2006.01) |
| ***B66D 1/46*** | (2006.01) |
| ***B66D 1/14*** | (2006.01) |
| ***B66D 1/74*** | (2006.01) |
| ***B66D 1/00*** | (2006.01) |

(52) U.S. Cl.

CPC ..... *B66D 3/006* (2013.01); *B66D 1/00* (2013.01); *B66D 1/12* (2013.01); *B66D 1/14* (2013.01); *B66D 1/36* (2013.01); *B66D 1/46* (2013.01); *B66D 1/7447* (2013.01)

(58) Field of Classification Search

CPC ... B66D 1/00; B66D 1/12; B66D 1/14; B66D 1/36; B66D 1/46; B66D 1/7447; B66D 3/006

See application file for complete search history.

(56) References Cited

U.S. PATENT DOCUMENTS

| | | | | | |
|---|---|---|---|---|---|
| 1,566,740 | A * | 12/1925 | Forrest | B60D 1/185 | 280/480 |
| 2,740,537 | A * | 4/1956 | Johnston | B66C 23/66 | 212/177 |
| 3,054,572 | A * | 9/1962 | Williams | H02G 1/04 | 242/419.9 |
| 4,191,416 | A * | 3/1980 | Nist | A62B 1/00 | 254/399 |
| 4,457,527 | A * | 7/1984 | Lowery | B25H 1/04 | 182/127 |
| D365,012 | S * | 12/1995 | Sather | D8/359 | |
| 5,722,640 | A * | 3/1998 | Skyba | B66D 1/7415 | 254/333 |

(Continued)

*Primary Examiner* — Michael E Gallion

(74) *Attorney, Agent, or Firm* — Kilpatrick Townsend & Stockton LLP

(57) ABSTRACT

A portable winch system includes a frame, a pair of wheels, a motor that is secured to the frame; and a capstan that is secured to the frame and that is rotatable via the motor. A rope is wound about the capstan in a manner that enables a user to grasp a tail end of the rope and induce friction between the capstan and the portion of the rope that is wound about the capstan. A tow end of the rope is attachable to an object to be pulled by the winch. An input guide attached to the frame is configured to receive the rope and direct the rope toward the capstan as the object is pulled toward the winch. An alignment guide attached to the frame is configured to contact the rope and align the rope about the capstan as the rope is wound about the capstan.

19 Claims, 11 Drawing Sheets

(56) References Cited

U.S. PATENT DOCUMENTS 6,056,273 A * 5/2000 Smith ..... B66C 5/025 248/163.1
6,059,266 A * 5/2000 Ascherin ..... B64D 1/22 242/397.5
6,065,621 A * 5/2000 Fatemi ..... B66C 23/48 212/264
6,138,992 A * 10/2000 Bell ..... B66D 1/00 224/519
6,231,030 B1 * 5/2001 Smith ..... A01G 23/006 254/324
6,257,555 B1 * 7/2001 Barbara ..... B66D 3/14 248/163.1
6,283,455 B1 * 9/2001 Ascherin ..... B64D 1/22 242/397.5
6,412,602 B1 * 7/2002 Sundman ..... A62B 1/14 182/133
6,702,608 B2 * 3/2004 Brennan, Jr. ..... B25H 3/00 280/47.19
6,951,345 B2 * 10/2005 Wilks ..... B60D 1/36 242/397.5
7,290,755 B1 * 11/2007 Thibodeaux ..... B60D 1/38 254/323
7,559,736 B1 * 7/2009 Mohan ..... B60P 1/027 254/2 C
7,913,978 B1 * 3/2011 Trihey ..... B66D 3/006 254/323
7,934,698 B2 * 5/2011 Ball ..... B66D 1/7489 254/371
8,579,085 B2 * 11/2013 Bogaert ..... E04G 3/325 182/128
8,783,660 B1 * 7/2014 Riddle ..... B60S 11/00 254/418
9,427,606 B2 * 8/2016 Ball ..... B66D 1/7447
9,850,113 B2 * 12/2017 Melin ..... B66D 1/7415
10,501,294 B1 * 12/2019 Solberg ..... B66D 3/26
10,611,607 B1 * 4/2020 Williams ..... B66C 5/025
2004/0040925 A1 * 3/2004 Miller ..... B66C 23/44 212/180
2007/0045601 A1 * 3/2007 Rhee ..... A01K 79/02 254/383
2008/0048161 A1 * 2/2008 Meyer ..... B66F 3/12 254/2 R
2009/0152314 A1 * 6/2009 Myrex ..... B60R 9/06 224/502
2011/0168961 A1 * 7/2011 Christiansen ..... B66D 1/00 254/327
2012/0187355 A1 * 7/2012 Mehrkens ..... A63C 11/10 254/222
2014/0144861 A1 * 5/2014 Davis ..... B66C 23/44 212/230

* cited by examiner

TRAILER MOUNTED CAPSTAN WINCH

CROSS-REFERENCE TO RELATED APPLICATIONS

This application claims priority to Provisional U.S. Patent Application No. 62/564,910 filed Sep. 28, 2017, entitled "Trailer Mounted Capstan Winch," the entire disclosure of which is hereby incorporated by reference, for all purposes, as if fully set forth herein.

BACKGROUND OF THE INVENTION

Numerous winch devices exist for pulling trees or other objects, which are often called skidding winches. The vast majority of these devices are large and heavy units which mount to tractors via a shaft drive from a power take off (PTO). These devices are quite expensive and require that a user own or have access to an appropriate tractor or other similar unit. These devices typically have overload clutches since the tractor could potentially pull too hard, which may cause the tractor to roll due to offset loads or may cause the steel cable or other tension member to break. An additional issue with these devices is that the steel cable that is typically used has a tendency to kink or the individual strands may break, which are a nuisance or hazard to operators. These devices also typically spool cable onto a fixed size drum so the length of cable that may be used has a specific length limit. The tractor and winch are also relatively large, which restricts or limits where the devices may be used.

On the other end of the spectrum are small, portable capstan rope winches. These devices are intended to be carried into the forest via backpack and commonly weight between 25 and 35 lbs. Given that these devices are intended to be carried between locations, these devices require a certain strength to be transported between locations, especially in hilly or uneven terrains. While being very portable, these devices have small engines and small pulling capacities. These devices commonly pull at very slow speeds due to the small engines. These devices commonly employ a capstan spool and textile rope. The rope itself may weigh around 25 lbs or more, thus increasing the strength requirement of the operator to transport the device. These devices are typically fastened to a tree to provide an anchor point to pull from. An operator is required to careful align the load in the direction of pull for smooth operation of the device. For example, in order to pull trees that are oriented in various directions, the device must be realigned each time a different tree is pulled in order to ensure smooth operation of the device. Alternatively, a snatch block may be used to maintain direction a direction of the device and then the snatch block may be released as the log approaches the snatch block. Because friction is high in pulling operations and because the engine is small, the pulling capacity of these devices is very limited, which dramatically limits the utility of these devices.

BRIEF SUMMARY OF THE INVENTION

The embodiments described herein provide a highly portable winch system for getting into difficult areas of a forest or other area to quickly pull several thousand-pound objects, such as large logs for various purposes including fire mitigation, forest management, or firewood for fuel. According to one aspect, a portable winch system includes a frame or base upon which one or more components are fixedly secured and a pair of wheels that are attached to a bottom end of the frame or base to allow the winch to be transported between locations. The portable winch system also include a hitch or attachment member that is attachable to a vehicle to allow the winch to be transported between said locations. A motor is fixedly secured to the frame or base and a capstan or drum is rotatably secured to the frame or base and is operably coupled with the motor so that the capstan or drum is rotatable via the motor. A rope or cord is wound about the capstan or drum multiple times. The rope or cord includes a tow end that extends from the capstan or drum in a first direction and a tail end that extends from the capstan or drum in a second direction. The tow end of the rope or cord is attachable to an object to be pulled by the portable winch system and the tail end of the rope or cord is graspable by a user to induce friction between the capstan or drum and the section of the rope or cord that is wound about the capstan or drum.

An input line guide is fixedly secured to the frame or base and is positioned adjacent the capstan or drum. The input line guide is configured to slidably receive the tow end of the rope or cord to direct the tow end of the rope or cord toward the capstan or drum so that the tow end of the rope or cord is wound about the capstan or drum as the object is pulled toward the winch. An alignment guide is fixedly secured to the frame or base and is positioned radially outward of an outer surface of the capstan or drum. The alignment guide is configured to contact the rope or cord to align the rope or cord about the capstan or drum and thereby create a space for the tow end of the rope or cord as the tow end of the rope or cord is wound about the capstan or drum from the input line guide. An output line guide is fixedly secured to the frame or base and is positioned adjacent the capstan or drum. The output line guide is configured to slidably receive the tail end of the rope or guide to direct the tail end of the rope or cord from the capstan or drum so that the user may grasp the tail end of the rope or cord and induce said friction between the capstan or drum and the section of the rope or cord that is wound about the capstan or drum.

According to another embodiment, a portable winch system includes a frame or base, a pair of wheels that are attached to a bottom end of the frame to allow the winch to be transported between locations, and a motor that is fixedly secured to the frame or base. A capstan or drum is rotatably secured to the frame or base and is operably coupled with the motor so that the capstan or drum is rotatable via the motor. A rope or cord is wound about the capstan or drum multiple times. The rope or cord has a tow end that extends from the capstan or drum in a first direction and a tail end that extends from the capstan or drum in a second direction. The tow end of the rope or cord is attachable to an object to be pulled by the portable winch system and the tail end is graspable by a user to induce friction between the capstan or drum and the section of the rope or cord that is wound about the capstan or drum.

An input line guide is fixedly secured to the frame or base and is positioned adjacent the capstan or drum. The input line guide so configured to slidably receive the tow end of the rope or cord to direct the tow end of the rope or cord toward the capstan or drum so that the tow end of the rope or cord is wound about the capstan or drum as the object is pulled toward the winch. An alignment guide is fixedly secured to the frame or base and is configured to contact the rope or cord to align the rope or cord about the capstan or drum and thereby allow the rope or cord to be would about the capstan or drum in a defined manner.

BRIEF DESCRIPTION OF THE DRAWINGS

Various features, aspects, and advantages of the present invention will be better understood when the following detailed description is read with reference to the accompanying figures in which like characters represent like parts throughout the figures, wherein.

DETAILED DESCRIPTION OF THE INVENTION

Figure 1:
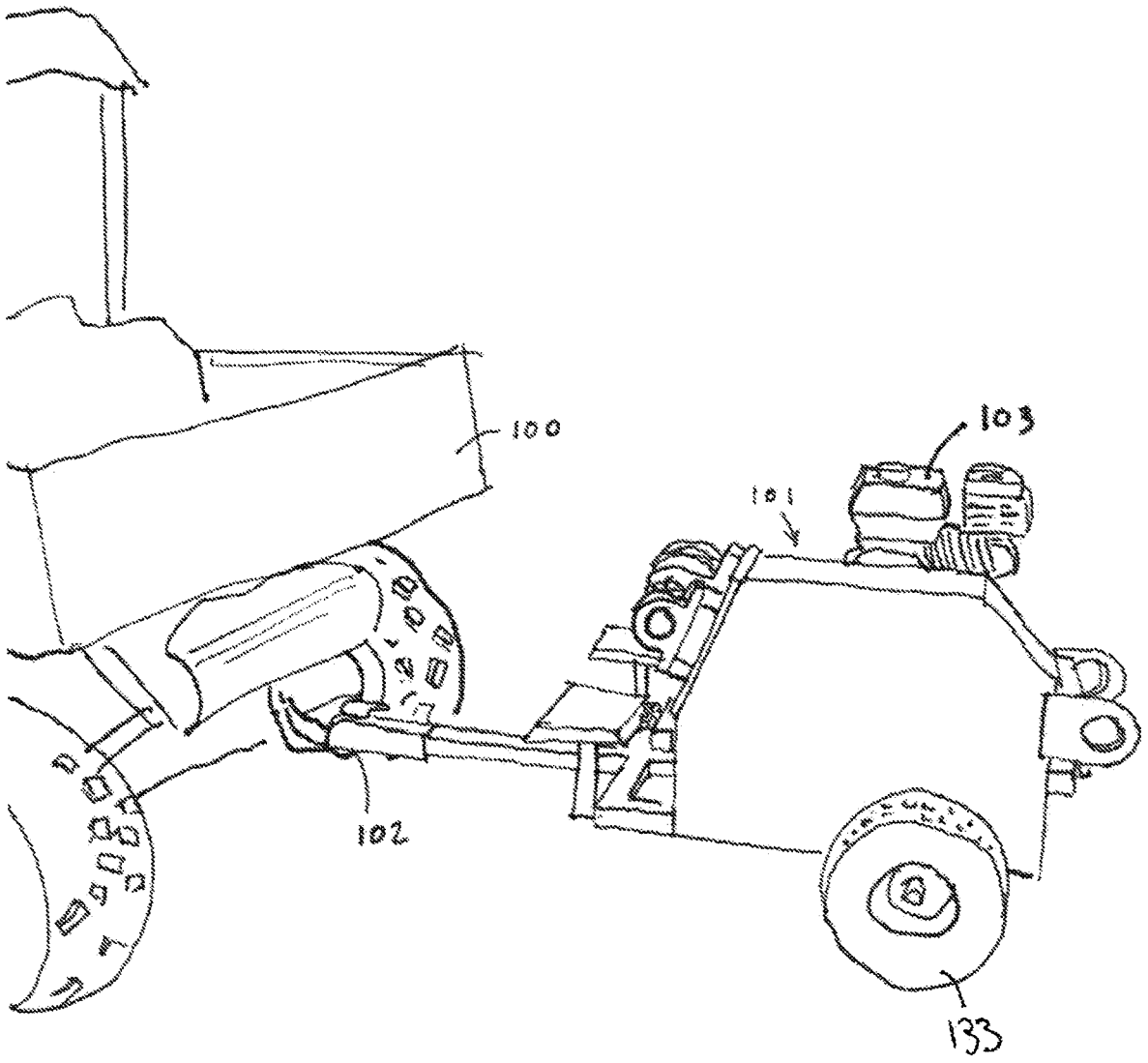
FIG. 1 is a perspective view of an ATV pulling the trailer mounted capstan winch.

The ensuing description provides exemplary embodiments only, and is not intended to limit the scope, applicability, or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments described herein provide a highly portable winch system that is able to be transported into difficult to reach, or relatively inaccessible, areas of a forest and able to quickly pull several thousand-pound logs to an area for fire mitigation, forest management, firewood for fuel, etc. In such uses, the portable winch system may be referred to as a log skidder. Other uses of the portable winch system include pulling stumps; pulling stuck vehicles out of ditches, snow, mud; moving large rocks such as for building landscape features; raising pre-built walls or materials on a construction site, typically with the addition of one or more snatch blocks; pulling wire through conduit; putting tension on trees in order to encourage the desired fall direction; pulling pipe; and/or various other uses for powered hoists. The portable winch system is a device with a small footprint and is able to use a rope or cord with essentially unlimited line length desired with.

The portable winch system is transportable manually or via a vehicle, such as an all-terrain vehicle (ATV). In today's environment, it is much more likely that the average person owns an ATV rather than a tractor due to the ATV's versatility, mobility, low cost, and utility. Many people use ATVs to pull logs, but the pulling capacity has limitations as ATVs may be prone to tire punctures in natural settings full of dead branches or stumps. In addition, it may be tiring and difficult work to maneuver the ATVs into place, to turn the vehicles around, and to simultaneously watch for obstacles. There are also limitations on how steep of terrain can be traversed with an ATV and how maneuverable such vehicles are through brush, rocks, and stumps.

The portable winch system described herein is a lightweight and small trailer mounted device that is able to be transported by an ATV or any other vehicle. The portable winch system is designed to be driven to the desired location and strapped to a nearby tree, stake, truck or other solid object as necessary for the size of load being winched. A rope, cable, or cord, such as a double braided arborist rope, may be attached to the tree or object to be pulled by the portable winch system. The rope, cable, or cord (hereinafter rope) may be attached to the tree or object using a choker chain. An operator may then return to the portable winch system, utilize provided safety equipment, start the motor, wrap the rope around a capstan or drum (typically between 2 and 4 wraps) to generate appropriate friction, and tail and pile the rope as the log or other object is pulled by the portable winch system. In logging applications, the portable winch system is easily able to manage logs of up to 24 inches in diameter and 12 feet long, although the portable winch system can be sized for different loads and speeds as desired.

Special sliding outrigger feet allow the frame or base of the portable winch system to position itself in line with the load being pulled to minimize potential hazards, such as flipping of the machine due to offset loads. A special roller guide separates the rope on the drum for smooth winding at low friction and eliminates any potential for miss winding or tangling. The portable winch system may utilize an economical single cylinder gasoline or diesel engine, such as an engine of about 4 horsepower and 2500 RPM output although various other sized motors could be used. For low cost and efficiency, a 3 stage chain reduction is used to bring the RPM down to a desired speed, such as to about 60 RPM.

A capstan drum is used with various guides to allow an operator to easily and continuously tail the rope at a safe distance while a log or other object is pulled toward the portable winch system. The log or object may be pulled at approximately 60 feet per minute (FPM) with the appropriate drum size which is a reasonable speed for safety and efficiency. The log or other object may be pulled at a faster or slower speed as desired depending on the size of the motor, the size of the capstan or drum, and/or the chain reduction that is employed. Special guides are used to preserve the rope and minimize friction as the rope is wound about the capstan or drum.

In addition to winching a load such as a log, the portable winch system has an auxiliary front steerable wheel, which allows the rope and winching drum to be used to pull the portable winch system through the woods under its own power. The steerable wheel allows the portable winch system to be steered by the operator as the portable winch system is pulled through the woods under its own power, which allows the portable winch system to be maneuvered or transported without use of an ATV or other vehicle. The portable winch system can be used this way for descending a hill or climbing a hill using the rope anchored to a fixed object.

Having described features of the portable winch system generally, additional features and aspects of the portable winch system will be readily evident with reference to the description of the various drawings, which is provided herein below.

Referring to FIG. 1, an all-terrain vehicle (ATV) 100 is depicted that is attached to a frame or base 111 (see FIG. 3) of the portable winch system 101. The frame or base 111 is attached to a trailer hitch 102 of the ATV. A hitch or attachment member is secured to the frame or base 111 of the portable winch system 101 and is attachable to the ATV to allow the portable winch system 101 to be transported between various locations for pulling objects with the portable winch system 101. Any vehicle with a trailer ball or pintle could be used to transport the portable winch system 101, although ATVs are small and commonly used by professionals and amateurs alike. A pair of wheels 133 are attached to a bottom end of the frame or base 111 to allow the winch to be easily transported between locations. A motor 103 is fixedly secured to the frame or base 111. For example, a single cylinder 212 cc gasoline engine may be attached to the frame or base 111. This engine has been demonstrated to have adequate power and speed for average needs, although other engine displacements and fuel types could be used. In other embodiments, hydraulic motors powered by various means may be used.

Figure 2:
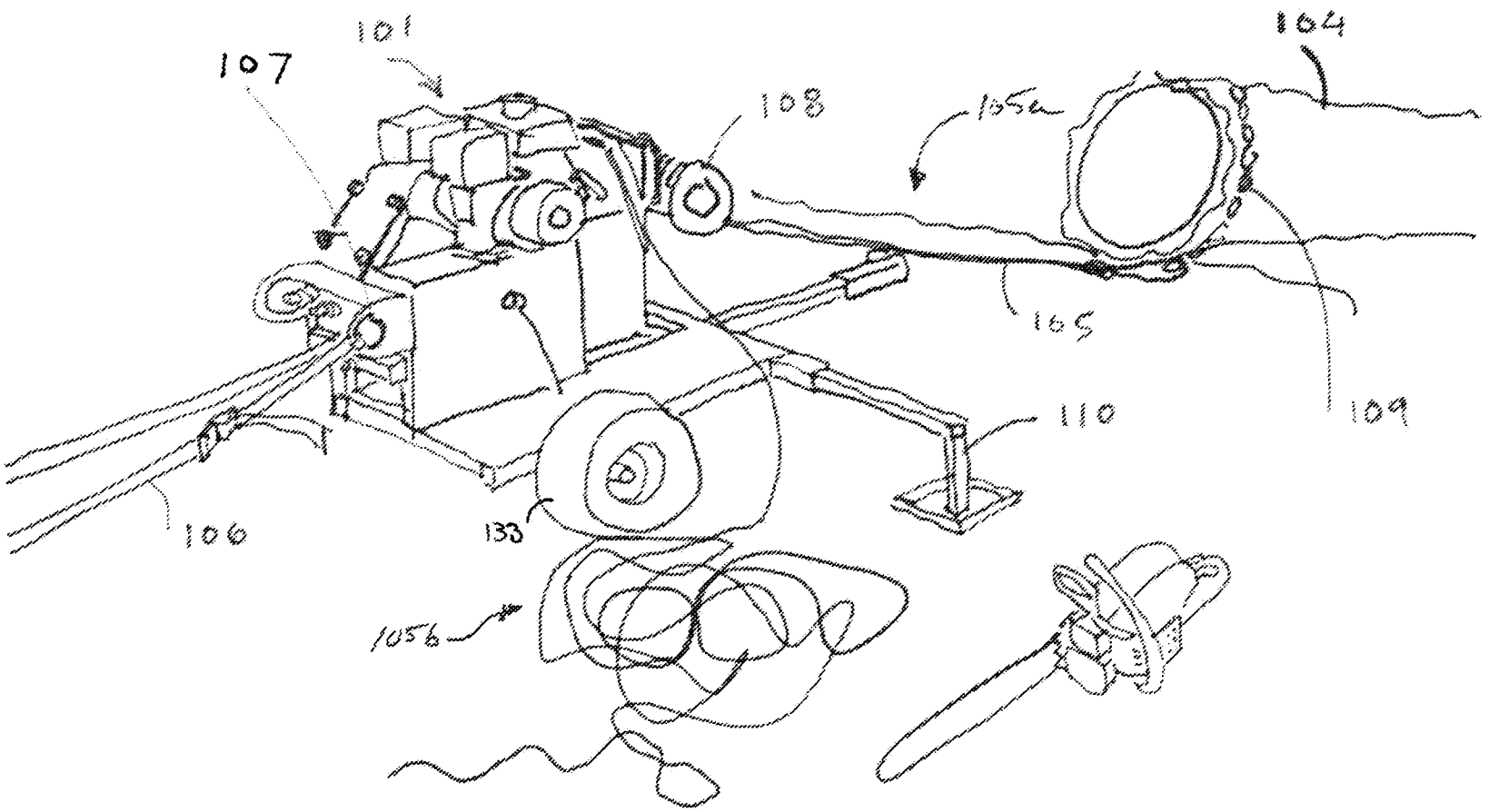
FIG. 2 illustrates the trailer mounted capstan winch set up for use pulling a felled log section.

Referring now to FIG. 2, the portable winch system 101 is shown being used to pull a felled log 104. The portable winch system 101 includes an anchor point or member 107 that is attachable to an anchoring rope, strap, chain, or cord 106, which is in turn attached to a suitably strong anchor point like a live tree, a vehicle of adequate weight, a rock, a stake in the ground, or any other secure object. The portable winch system 101 is attached to the strong anchor point in order to anchor the portable winch system 101 to the secure object during use of the device. In the illustrated embodiment, the anchor member 107 is an anchor ring that is attached to a suitable rope, strap, chain, or cord of sufficient strength. The portable winch system 101 may include a single anchor point or member 107, or may include multiple anchor points or members to suitably anchor the portable winch system 101 to a desired location.

The felled log 104 may be choked by a chain with slip hook 109 that is attached to a rope, cable, or cord 105 (hereinafter rope 105). The rope 105 could be a polyester double braid with a diameter of from ⅜ inch to ⅝ inch with a breaking strength of greater than 2000 lbs. The rope 105 has a tow end 105*a* that extends from a capstan or drum 108 in a first direction and a tail end 105*b* that extends from the capstan or drum 108 in a second direction. The tow end 105*a* of the rope 105 is attached to the felled log 104 via the chain. As described herein, the tail end 105*b* of the rope 105 is graspable by a user (not shown) to induce friction between the capstan or drum 108 and a section of the rope 105 that is wound about the capstan or drum 108. FIG. 2 illustrates the tail end 105*b* of the rope 105 being tailed and piled as the log 104 is pulled by the portable winch system 101.

The rope 105 is wrapped around the capstan or drum 108 (hereinafter capstan 108) typically between 2 and 4 times. In a specific embodiment, the rope 105 is wrapped 3 times around the capstan 108, which is ideal for creating enough friction to make tailing or pulling of the rope 105 from the drum relatively easy without creating so much friction that the load (e.g., felled log 104) cannot be easily stopped by releasing tension in the tail end 105*b* of the rope 105. The capstan 108 may be made of aluminum or any other suitable material. The capstan 108 configuration of the portable winch system 101 allows for an endless length of rope 105 to be used, although a typical length of rope 105 is between 150 and 200 feet.

The portable winch system 101 includes one or more slideable outrigger feet 110 that support a front portion of the frame or base 111. The slideable outrigger feet 110 are deployable from the frame or base 111 and may be stowed about the frame or base 111 as descried herein. The slideable outrigger feet 110 include a slide plate that engages the ground and that distributes a weight of the front portion of the frame or base 111 about the ground so that the front portion of the frame or base 111 is able to pivot or slide atop the ground in response to a tension in the tow end 105*a* of the rope 105 due to the felled log 104 or other load being pulled by the portable winch system 101. The pivoting or sliding of the front portion of the frame or base 111 allows the portable winch system 101 to self-align with the object being pulled, such as the felled log 104. The slideable outrigger feet 110 are critical for safety to allow the frame or base 111 to pivot around the anchor ring 107 and thereby self-align to a direction of the load without tipping over. The configuration of the portable winch system 101 enables the device to be used on flat ground, to be lowered and anchored on very steep hills, and/or to be maneuvered into tight and uneven spaces. Sometimes snatch blocks can be used to provide pulleys in various intermediate locations in order to snake or move a tree or other object through various obstacles, such as brush and rocks. The outrigger feet 110 are insertable within tubing that extends laterally from the frame or base 111 in order to secure the outrigger feet 110 to the frame or base 111 in the deployed configuration.

Figure 3:
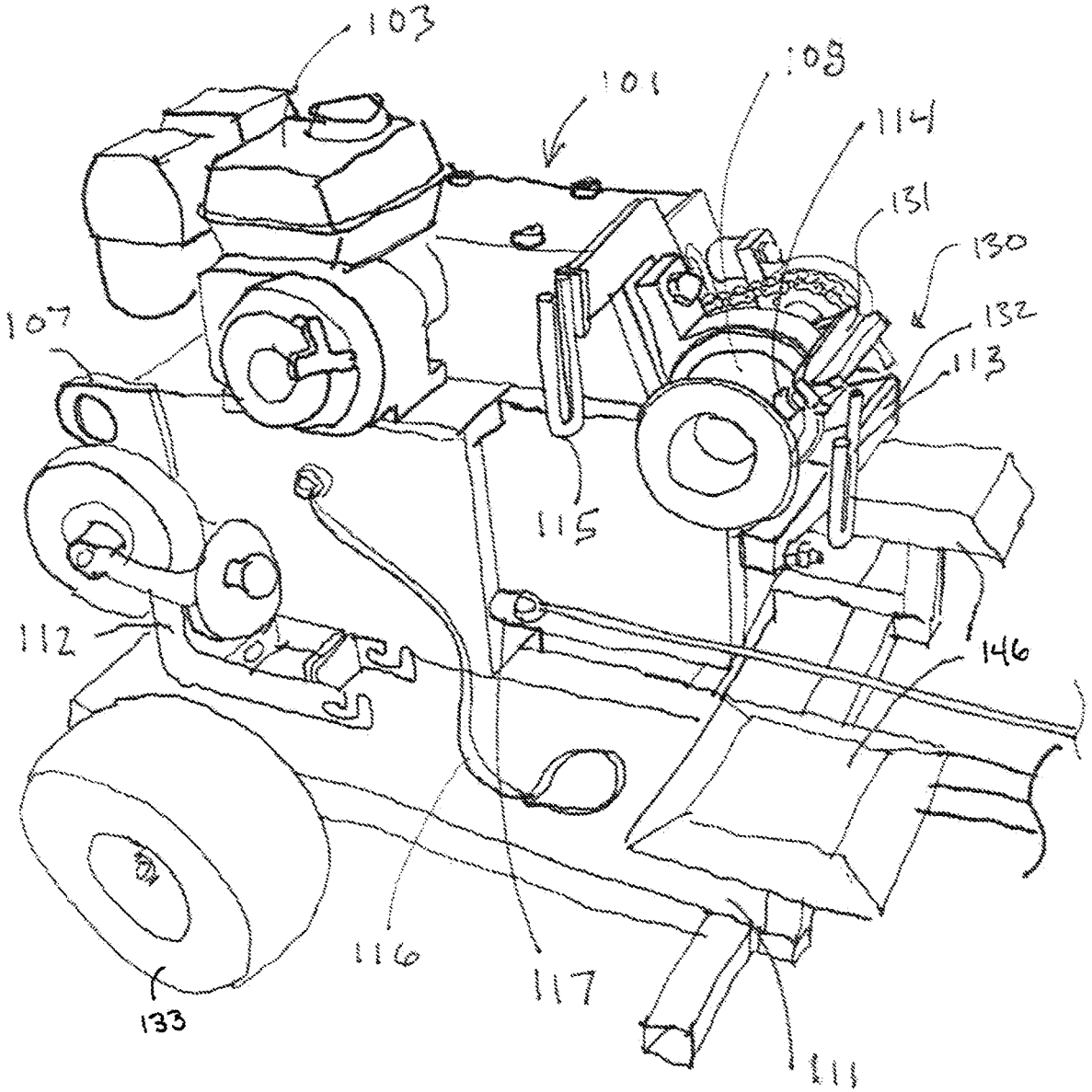
FIG. 3 illustrates an overview of the trailer with major components being visible.

Referring now to FIG. 3, various components of the portable winch system 101 are illustrated in greater detail. The frame or base 111 of the portable winch system 101 is readily evident, as is the engine 103 that is fixedly mounted to the frame or base 111. A 3 stage chain and sprocket speed reduction mechanism is disposed within a housing that is fixedly secured to the frame or base 111. The 3 stage reduction mechanism is configured to reduce a rotational speed of the capstan 108 to a required speed for a desired rate of pull and force for moving the object, such as approximately 60 FPM. In other embodiments, the chain and sprocket speed reduction may include more or fewer stages or may be configured to achieve essentially any rotational speed reduction that is desired.

The capstan 108 is rotatably secured to the frame or base 111, or more commonly is rotatably secured to the housing that is fixedly secured to the frame or base 111. The capstan 108 is operably coupled with the motor 103 so that the capstan 108 is rotatable via the motor 103. An input line guide or infeed guide 113 (hereinafter infeed guide 113) is fixedly secured to the frame or base 111, or more commonly fixedly secured to the housing that is secured to the frame or base 111. The infeed guide 113 is positioned adjacent the capstan 108 and is configured to slidably receive the tow end 105*a* of the rope 105 to direct the tow end 105*a* of the rope 105 toward the capstan 108 so that the tow end 105*a* of the rope 105 is wound about the capstan 108 as the object is pulled toward the portable winch system 101. The infeed guide 113 is U-shaped and has an open top end, which allows the tow end 105*a* of the tope to be easily inserted within the infeed guide 113. The U-shaped guide supports the tow end 105*a* of the rope 105 when the portable winch system 101 is not in use.

The portable winch system 101 also includes an alignment guide 114 that is fixedly secured to the frame or base 111, or more commonly secured to the housing that is secured to the frame or base 111. The alignment guide 114 is positioned radially outward of an outer surface of the capstan 108 and is configured to contact the rope 105 to align the rope 105 about the capstan 108 and thereby allow the rope 105 to be would about the capstan 108 in a defined manner, such as by creating a space for the tow end 105*a* of the rope 105 as the rope is wound about the capstan 108 from the infeed guide 113. In some embodiments, the infeed guide 113 and the alignment guide 114 are disposed on a distal end of a support member 130 (see FIGS. 3 and 4) that extends over a portion of the capstan 108. The support member 130 has a proximal end that is fixedly secured to the frame or base 111 and more commonly is secured to the housing that is secured to the frame or base 111. The proximal end of the support member 130 may be fixedly secured to the housing underneath the capstan 108. In some instances, the infeed guide 113 is attached to a distal end of a first arm 132 of the support member 130 and the alignment guide 114 may be attached to a distal end of a second arm 131 of the support member 130. The first arm 132 may be positioned below the second arm 131. The alignment guide 114 may extend radially inward from a bottom surface the second arm 131 and toward the outer surface of the capstan 108.

The portable winch system 101 also includes an output line guide or outfeed guide 115 (hereinafter outfeed guide 115) that is fixedly secured to the frame or base 111, and more commonly secured to the housing that is secured to the frame or base 111. The outfeed guide 115 is positioned adjacent the capstan 108 and is configured to slidably receive the tail end 105*b* of the rope 105 to direct the tail end 105*b* of the rope 105 from the capstan 108 so that the user may grasp the tail end 105*b* of the rope 105 and induce friction between the capstan 108 and the section of the rope 105 that is wound about the capstan 108.

In coupling the rope 105 to the capstan 108 and the portable winch system 101, the rope 105 is inserted or passed through the infeed guide 113 before being wound onto the capstan 108. The rope 105 is positioned so that an inner most wrap is directly adjacent and contacts the alignment guide 114. The alignment guide 114 is critical to ensure that sufficient space is created for the tow end 105*a* of the rope 105 as the tow end 105*a* is pulled toward the portable winch system 101 and immediately wound around the capstan 108. From the capstan 108, the rope 105 is passed through the open outfeed guide 115 allowing the operator to stand at a safe and comfortable position off to the side of the portable winch system 101 while tailing (tending and tensioning) and piling the tail end 105*b* of the rope 105.

FIG. 3 also shows one of the anchor members 107, which is generally in line with the capstan 108. An auxiliary steerable front wheel 112 is also visible and is shown in a stowed position about the portable winch system 101. Various safety features are also visible in FIG. 3, which include a user switch 116, a remote switch 121, and a tow end switch 117. The user switch 116 has a first end that is attached to the portable winch system 101 and a second end that is attached to the operator, such as by positioning a strap over the operator's wrist. The user switch 116 is configured so that detachment of the user switch from the portable winch system 101 causes the motor to shut off. Specifically, when a cord of the user switch 116 is pulled, a cover is removed from the switch end that is attached to the portable winch system 101, which changes its state and kills the engine.

As explained in greater detail herein, the remote switch 121 is wirelessly coupled with a processing unit of the portable winch system 101. The remote switch 121 is configured to shut off the motor in response to a signal being communicated from the remote switch to the processing unit. The tow end switch 117 is configured to automatically shut off the motor if a distal end of the tow end of the rope or cord becomes sufficiently close to the frame or base 111. The tow end switch 117 is designed as a system safety device that kills the engine if the operator does not release tension on the tail end 105*b* of the rope 105 before the load hits the portable winch system 101.

Figure 4:
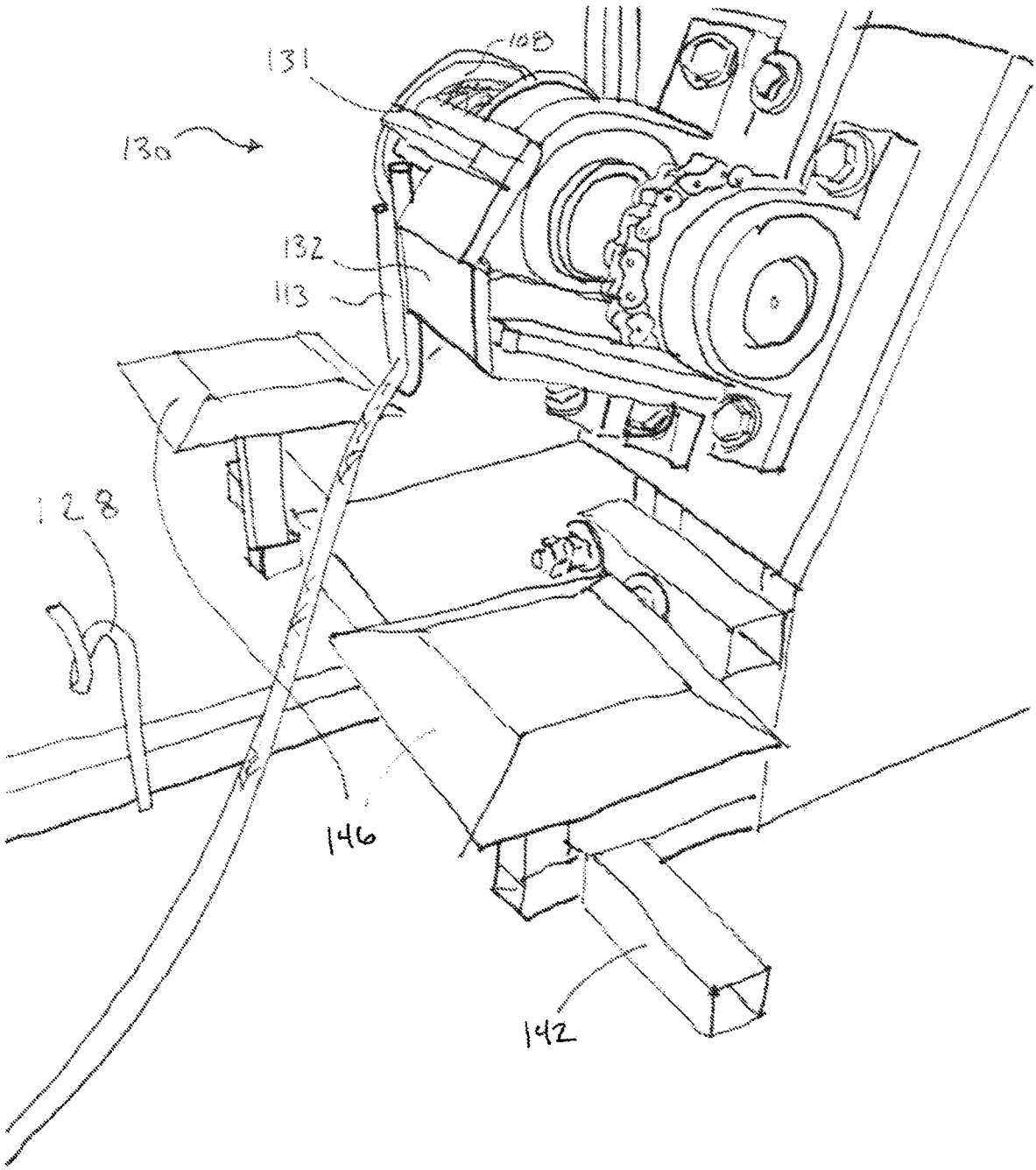
FIG. 4 illustrates a front of the trailer with sliding outrigger feet in a stowed position.

FIG. 4 illustrates a closer look at the outrigger feet or supports 110. The outrigger feet 110 expand the width of the frame or base 111 when deployed to prevent overturning of the portable winch system 101. In FIG. 4, the outrigger feet 110 are shown positioned in a stowed orientation in which the outrigger feet 110 are plugged or inserted into a compartment, such as longitudinal square tubes of the frame or base 111. Stowage of the outrigger feet 110 in this manner minimizes the space that the feet occupy as the portable winch system 101 is transported between locations and/or before the portable winch system 101 is used. When deployed, the outrigger feet 110 are plugged or inserted into transverse receiver tubes 142 and are quickly attached to the receiver tubes 142 using cotterless pins, ball detent pins, lynch pins, bungee cords, and the like. In this manner, the outrigger feet 110 may be quickly stored and deployed about the frame or base 111.

Figure 5:
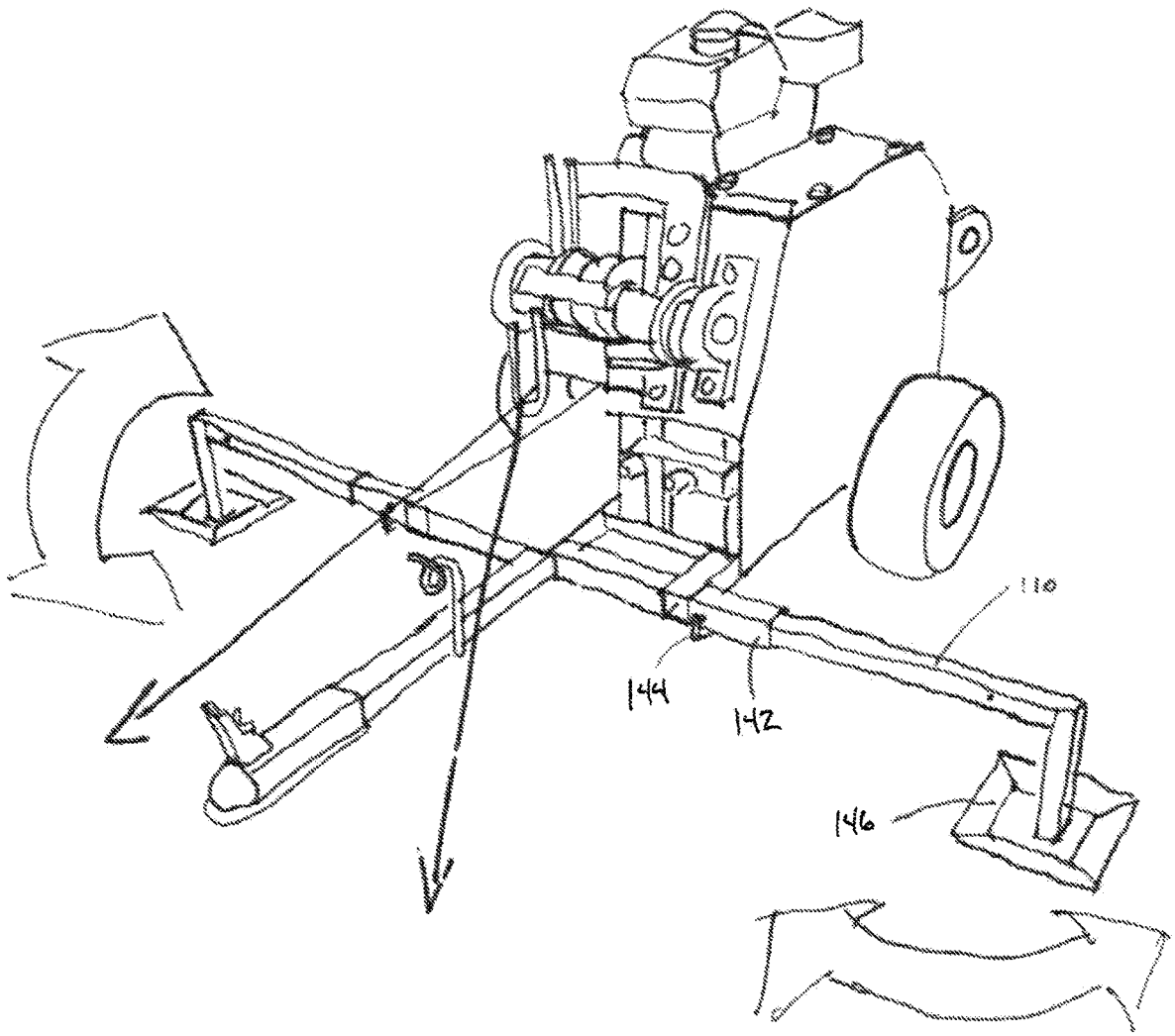
FIG. 5 illustrates the trailer with the sliding outrigger feet deployed and further illustrates an ability of the trailer to swivel about the sliding outrigger feet towards a load.

FIG. 5 illustrates the outrigger feet 110 in a deployed configuration in which the outrigger feet 110 are inserted within the receiver tubes 142 and extend laterally outward from the frame or base 111. The arrows adjacent the outrigger feet 110 depict how the entire portable winch system 101, and specifically the frame or base 111, can swivel about the rear anchor member 107 to align the portable winch system 101 to a direction of the load being pulled by the portable winch system 101. It is important that the outrigger feet 110 be able to slide along the ground and not hang up and create an overturning moment. To ensure that the outrigger feet 110 are able to slide about the ground without hanging, snagging, or catching on surrounding objects, large bevels or slide plates 146 are positioned on the outrigger feet 110, which enable the feet to slide over rocks or other obstacles. In FIG. 5, lynch pins 144 are illustrated in place to quickly secure the outrigger feet 110 to the receiver tubes 142.

Figure 6:
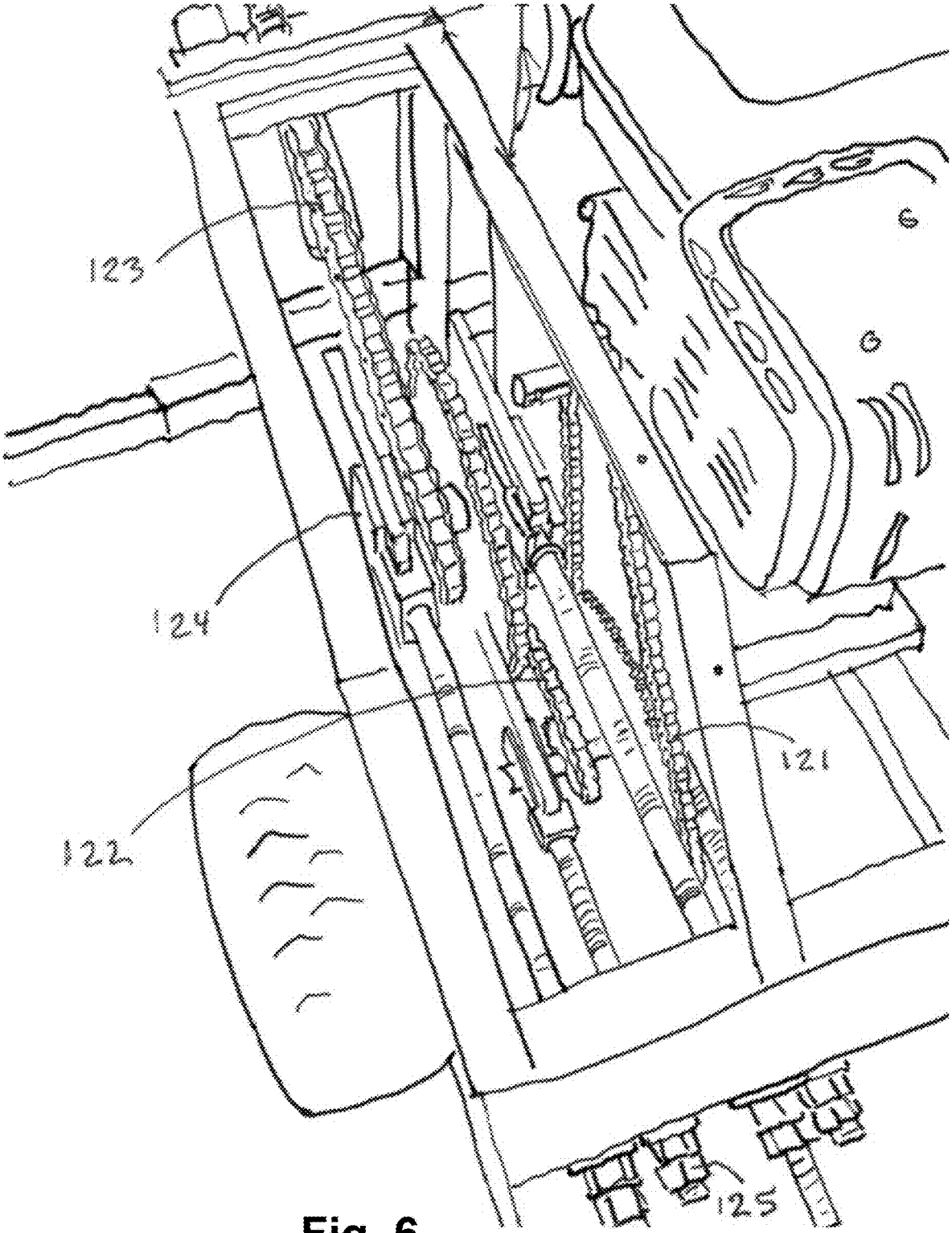
FIG. 6 illustrates a three stage chain reduction with take-up bearings and chain tension adjustment.

A multi-stage chain and sprocket system may be used to decrease the nominal RPM of an ungeared internal combustion engine to the speed and torque necessary to pull an object. Many speed reducing systems are possible such as gear reduction, cone drives, cog belts, variable speed v-belt, cycloidal reducers, and the like. A chain drive is typically trouble free, low cost, and has low precision requirements. FIG. 6 illustrates a chain drive system that uses three stages of reduction to achieve a desired speed reduction. Stage 1 121 is operably coupled directly with the engine 103. Stage 2 122 includes a pair of sprockets on a first intermediate shaft and stage 3 123 is positioned on a second intermediate shaft that leads to a final shaft that is attached to the capstan 108. Take-up ball bearing units 124 are used at each end of each intermediate shaft to support the respective shafts. Threaded rod and locknuts 125 allow chain tension to be adjusted safely away from the moving chains. Other arrangements of conventional pillow block bearings or other support arrangements could be used. While a 3 stage reduction is illustrated in FIG. 6, more or fewer stages could be used or in combination with other kinds of speed reducers as desired.

Figure 7:
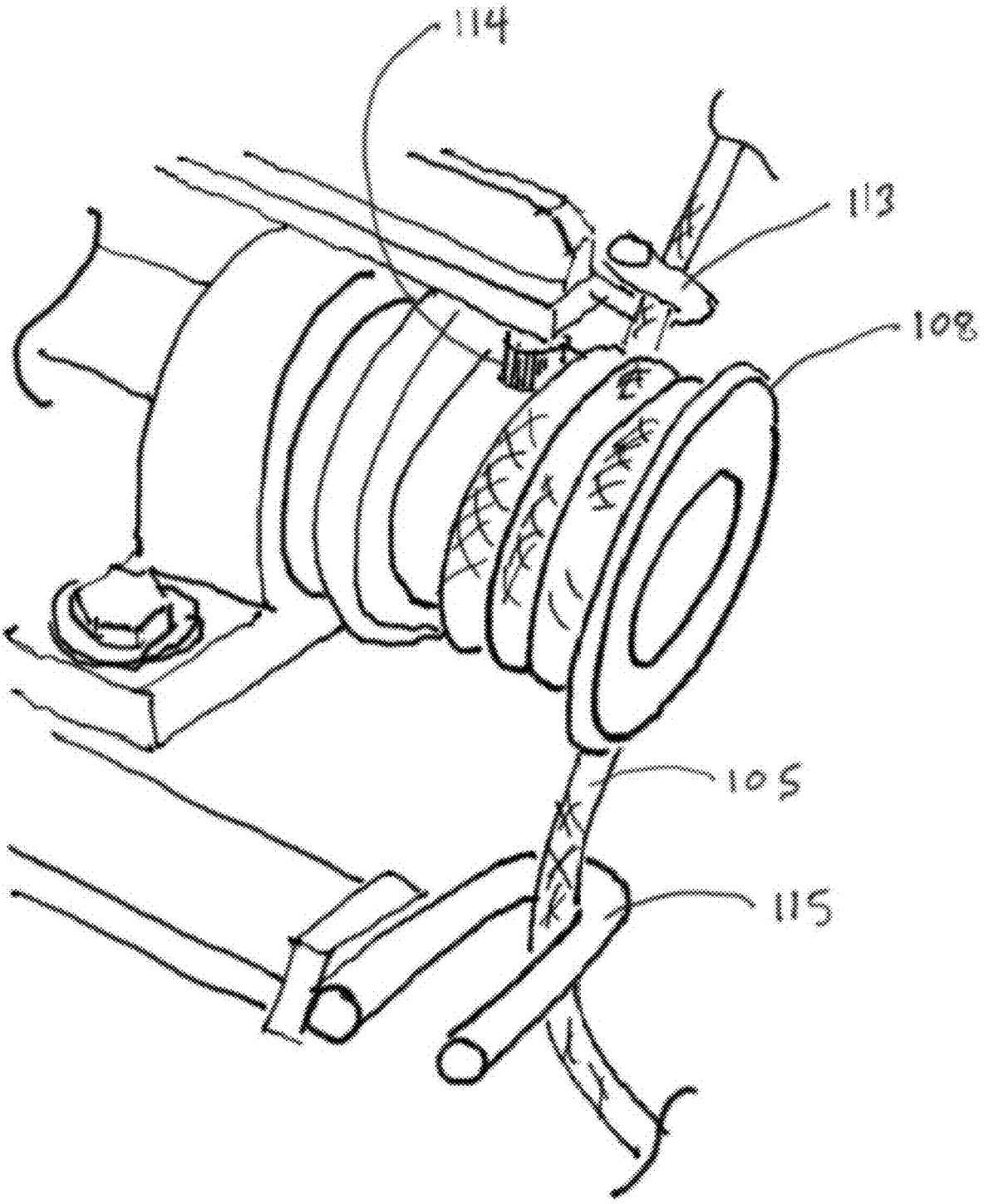
FIG. 7 illustrates a close up of a capstan drum with infeed, outfeed, and roller rope guide.

FIG. 7 illustrates a close-up view of the operation of the capstan 108 and rope management system, which includes the infeed guide 113, alignment guide 114, and outfeed guide 115. For conventional capstan systems to work without tangling, an operator must typically watch the rope or line and carefully stack the wraps of the rope or line about the capstan drum. Conventional capstan systems also depend on the rope or line coming from a constant direction. For the instant capstan system to operate, the rope 105 operation must be flawless in order for the system to adapt to a dirty rope, occasional debris on the rope, and/or a changing angle of entry and exit of the rope. This especially important in log skidding environments, wherein the load may be oriented at various angles relative to the portable winch system 101 and/or the rope may be relatively dirty or encounter a significant amount of debris. It is also important that the portable winch system 101 be able to minimize friction since the rope 105 often experiences thousands of pounds of tension, which results in very high friction forces being exerted between the rope 105 and capstan 108. If a space is not created for the tow end 105*a* of the rope 105 as the tow end of the rope is newly wrapped around the capstan 108, the rope 105 will pile on top of itself on the capstan 108 and immediately fowl the drum. To prevent this, the rope management system employs a very rigidly located alignment guide or bearing 114, which is typically a plain bearing, a cam follower bearing, a needle bearing, or a ball bearing. In a specific embodiment, the alignment guide is a ball bearing and more commonly a pair or plurality of ball bearing that are stacked in relation to one another and configured to roll along the tow end 105*a* of the rope 105 and create a separation necessary for the next coil or wrap of rope about the capstan 108.

A bottom end of the alignment guide 114 is positioned close to an outer surface of the capstan 108 to ensure that the rope 105 cannot force itself underneath the alignment guide 114 and between the alignment guide 114 and outer surface of the capstan 108. In some embodiments, the bottom end of the alignment guide 114 may be positioned between 0.030 and 0.100 inches from the outer surface of the capstan 108, and more commonly may be positioned between 0.040 and 0.075 inches from the outer surface of the capstan 108, and most commonly may be positioned between 0.050 and 0.065 inches from the outer surface of the capstan 108. In a specific embodiment, the bottom surface of the alignment guide 114 may be positioned approximately 0.062 inches from the outer surface of the capstan 108. The alignment guide 114 is also very tolerant to variable rope conditions. The infeed guide 113 and outfeed guide 115 are U-shaped or horseshoe shaped components that allow the rope 105 to be very quickly placed within the respective guide. The U-shape of the guides is also very tolerant to the rope 105 coming in at a high angle or low angle of attack in the vertical plane and from wide angles in the horizontal plane. In the horizontal plane, tension on the rope 105 at a wide angle will force the frame or base 111 to slide on the outrigger feet 110 toward the load being pulled. In this manner, the portable winch system 101 is able to align itself with the load being pulled, which reduces friction in the system. In some embodiments, the infeed and outfeed guides, 113 and 115, could have rolling sleeves over them if further friction reduction is desired. The infeed and outfeed guides, 113 and 115, may be made of inch steel rods, or any other suitable material and/or material sizes. The friction reducing functions or components of the portable winch system 101 enables the size of the engine 103 to be reduced for a particular pull force and speed. The alignment guide 114 may be positioned relative to the capstan 108 and infeed guide 113 so that the rope 105 is partially wound about capstan 108 before contacting the alignment guide 114. For example, from the infeed guide 113, the rope 105 may contact a bottom portion of the capstan 108 and begin winding around the capstan 108 before contacting the alignment guide 114, which may be positioned near an upper portion of the capstan 108. In such embodiments, the rope 105 may be wound around ¼ to ¾ of the capstan 108 before contacting the alignment guide 114, and more commonly may be wound around roughly ½ of the capstan 108 before contacting the alignment guide 114. The rope 105 is typically wound around at least ¼ of the capstan 108 before contacting the alignment guide 114.

The infeed guide 113, the alignment guide 114, and the outfeed guide 115 are each open ended, which allows the rope 105 to be positioned within each respective guide while the tow end 105*a* of the rope 105 is attached to an object to be pulled and/or while the tail end 105*b* of the rope 105 is grasped by the operator. Stated differently, the open ended configuration of the infeed guide 113, alignment guide 114, and outfeed guide 115 allows the rope 105 to be quickly attached to the portable winch system 101 without requiring insertion of one end of the rope 105 within or through any component. For example, in operation, the rope 105 is dropped or positioned in the infeed guide 113 and is wrapped an initially time about the capstan 108 immediately adjacent the alignment guide 114. The rope 105 is then wrapped one or more additional times about the capstan 108 and is dropped or positioned in the outfeed guide 115. In a specific embodiment, the rope 105 is wrapped about the capstan 108 approximately 3 times as illustrated in FIG. 7. The outfeed guide 115 allows the operator to stand in a wide range of positions both horizontally and vertically in relation to the portable winch system 101 while tailing (i.e., tending and tensioning) the tail end 105*b* of the rope 105 that is being unwound from the capstan 108 as the log is pulled toward the portable winch system 101.

Figure 8:
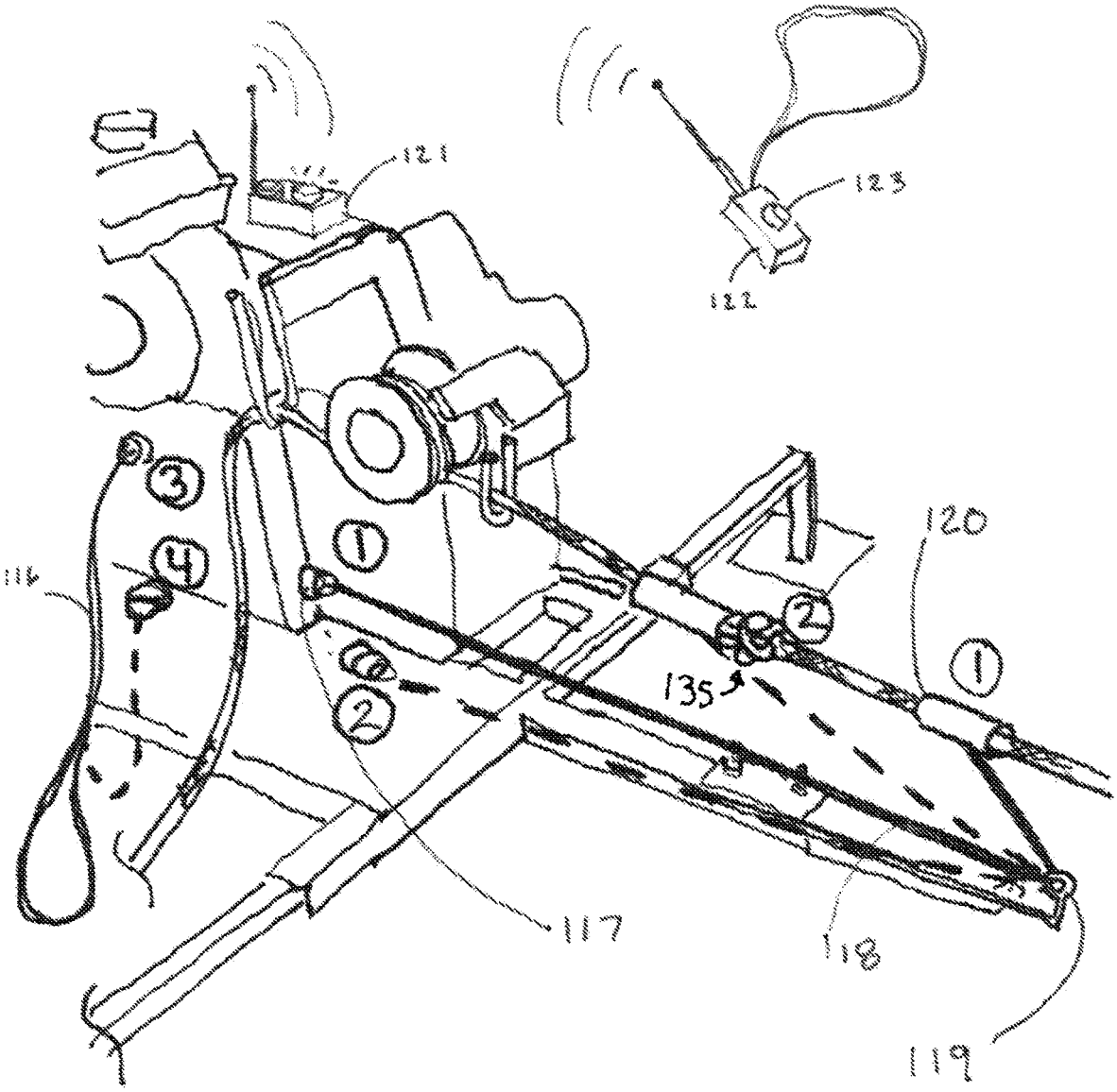
FIG. 8 illustrates various safety switch elements for automatically shutting of the engine of the winch.

FIG. 8 illustrates several safety elements that enable safe operation of the portable winch system 101. Main of the safety elements employ a switch that can be pulled by a cord to change the switch state to an off configuration and thereby kill or shut off the engine. Using this type of switch, a simple pull of a cord will actuate the switch and stop the system in an emergency stop fashion. In FIG. 8, a lanyard or cord is attached to a user switch 116, which is attached to the housing of the frame or base 111. When the lanyard is pulled, such as by an operator, a cap of the switch 116 is moved from a coupled or on position (i.e., position 3) to a decoupled or off position (i.e., position 4), which releases a limit switch allowing it to change state and thereby kill the engine 103. The switch is wired into the electrical system of the engine 103 and thus, changing the state disrupts the electrical system of the engine 103 thereby shutting the engine off. An operator may pull the lanyard or cord at any time to stop the system. This may be useful in various instances, such as if the anchor line becomes detached from the anchor member 107, someone dangerously crosses the path of the load or stumbles in front of the moving load, or for any other reason that an immediate stop may be desired. The kill switches are typically employed in addition to a normal start/stop switch and is mainly for instances of emergency.

The tow end switch 117 is designed to not allow the load (e.g., log) to be pulled into the capstan 108, which would damage the equipment. Various methods of employing a tow end switch 117 may be employed, such as a whisker switch, a trip wire, and the like. A specific method utilizes the same type of pull cord switch as mentioned in the preceding paragraph. Specifically, the tow end switch 117 is attached to a line of webbing 118 that is fed or routed through an eyelet 119 an a distal end of the frame or base 111. A distal end of the webbing 118 is attached to a slide member or tube 120 through which the tow end 105*a* of the rope 105 is passed or inserted. While the tow end 105*a* of the rope 105 is moving toward and being wound about the capstan 108 in a normal fashion, the slide member 120 floats or slides about or along the rope 105 (i.e., position 1 of the slide member 120) and the tow end switch 117 remains in a coupled or on position (i.e., position 1 of the tow end switch 117). If the operator is not paying attention, or otherwise does not release the tension in the tail end 105*b* of the rope 105 in sufficient time, and the load comes too close to the portable winch system 101, the slide member 120 comes into contact and engages a stop component 135, such as a knot that is tied at the end of the rope 105. Engagement of the slide member 120 and the stop component 135 causes the slide member 102 to move toward the capstan 108 (i.e., position 2 of the slide member 120), or toward the housing that is secured to the frame or base 111, which pulls on the webbing 118 and pulls a cap off the tow end switch 117 causing the tow end switch to move to a decoupled or off position (i.e., position 2 of the tow end switch 117). This causes the engine 103 to be automatically shut off. The tow end 105*b* of the rope 105 may be sufficiently close to the frame or base 111 to cause the engine 103 to be automatically shut off when a distal end of the rope 105 contacts and engages the slide member 120.

In one embodiment, the slide member 120 may be a cylindrical shaped plastic material or any other material. In some instances, the slide member 120 may be split with spring hinges to allow the tube to be quickly snapped over the rope 105 into position. The slide member 120 may also be a large open spring coil that is configured with an inside diameter large enough for the rope 105 to freely pass through the slide member 120 and with a coil spacing or stiffness such that it can be "screwed" over the rope 105 into position.

In many instances, the log or object that is being pulled by the portable winch system 101 is out of sight of the operator. In such instances, it is typically desirable to have a second person tending the log or object as it moves toward the portable winch system 101, such as up through the forest. It may be necessary at various times to roll or move the object or log, such as to dislodge it from stumps, trees, rocks, or other obstacles. In logging applications, the log may be moved using a device called a log cant. As previously described, it some instances it may be necessary to use snatch blocks at one or more intermediate points to direct the object or log on a snaking path through obstacles. Although releasing snatch blocks exist, in logging applications it is more comment to signal the operator to stop the log skidder when the log reaches the snatch block, which enables the rope 105 to be released from the snatch block. A convenient way to give some control to the remote person that is assisting in moving the object or log is via a remote device 122, such as a wireless dead man switch 122 that interfaces with the remote switch 121 of the portable winch system 101. In some instances, the engine 103 will operate as long as the remote person holds down a button 123 (if the switch is a momentary switch) or as long as the remote person has the button 123 switched to an "on" position (if the switch is a toggle switch). The remote switch 121 that is attached to the housing is wired into the run circuit of the engine 103 and thus, under normal situations, the remote device 122 will be set to allow the engine 103 to run. If the remote person actuates the remote device 122, the machine will remotely stop, which is useful when the operator cannot see the remote person and/or when an emergency situation is encountered by the remote person. The remote switch 121 on the housing may include lights that can indicate to the operator a state of the remote switch 123, such as an "on" state and an "off" state, which may allow the operator to not be confused as to why the engine 103 has been stopped.

Figure 9:
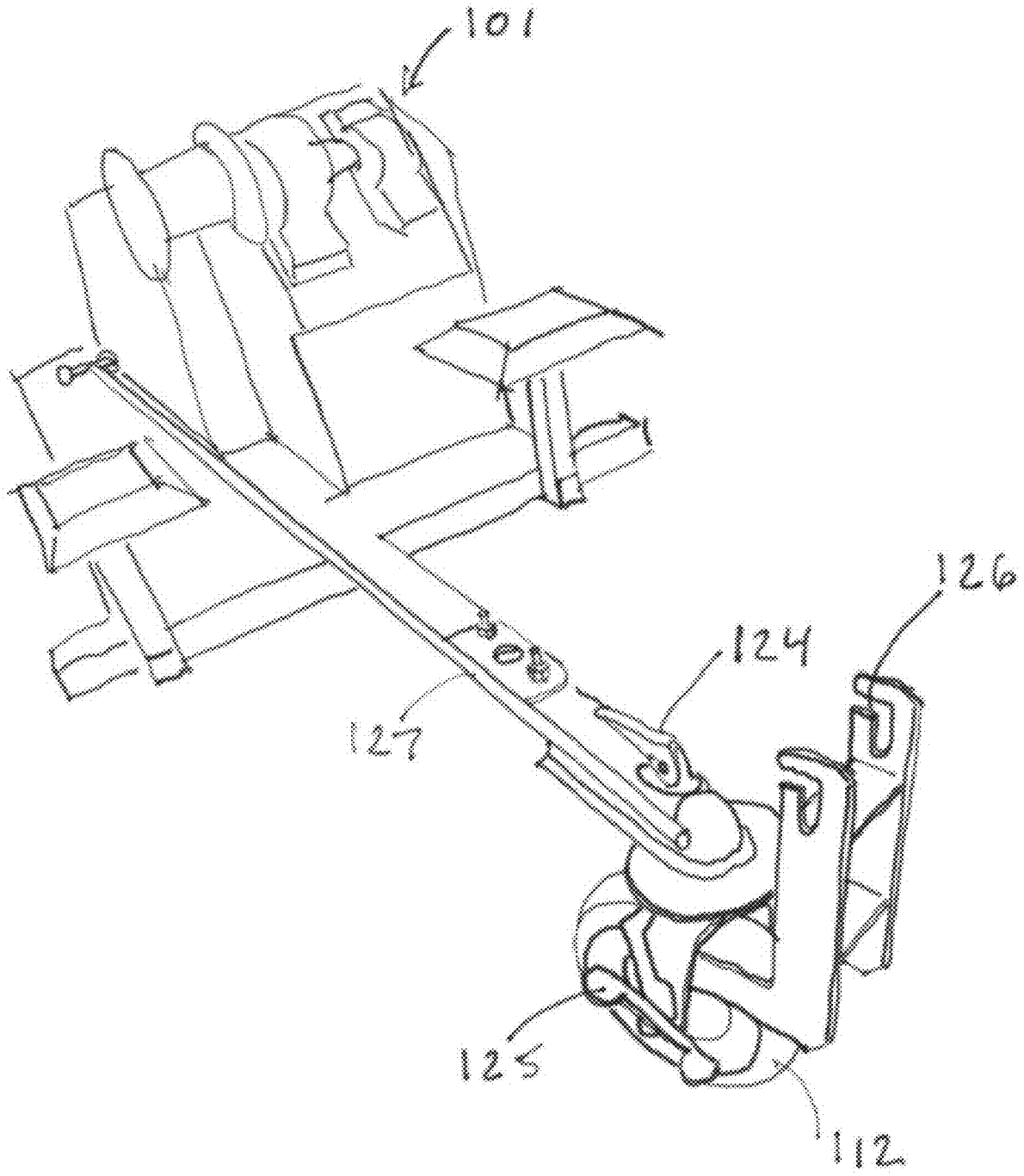
FIG. 9 illustrates the use of a removable, steerable front wheel.

To get into tight spaces, inclined surfaces, and/or rough surfaces that may not be traversable by an ATV or other vehicle, the portable winch system 101 has the capability to be maneuvered and powered on its own using the rope 105, capstan 108, engine 103 and a steerable front wheel 112. FIG. 9 illustrates the steerable front wheel 112, which is removably coupleable with the hitch or attachment member 124 of the portable winch system 101. The steerable front wheel 112 is attachable to the hitch 124 so that the steerable front wheel 112 is rotatable about an axis of the hitch 124. The steerable front wheel 112 is configured to guide or direct the portable winch system 101 when the portable winch system is being transported and is detached from the ATV or vehicle, such as when the portable winch system is being moved through terrain that is inaccessible by the ATV or vehicle. FIG. 9 illustrates the steerable front wheel 112 employing a compatible trailer ball that is able to attach to the hitch 124 so that the steerable front wheel 112 is able to pivot or swivel about the hitch 124. The steerable front wheel 112 may include a lockable 125 caster that allows the wheel to be locked in place. The steerable front wheel 112 has receivers 126 that are designed to attach to a detachable steering component or handle 127 for steering. The handle 127 is shown in its stowed position where it is held by fasteners, such as a pair of nuts as illustrated shown. The handle 127 is removably coupleable with the steerable front wheel 112 and is graspable by an operator to steer the steerable front wheel 112 during transport of the portable winch system 101 while the portable winch system is detached from the ATV or vehicle.

Figure 10:
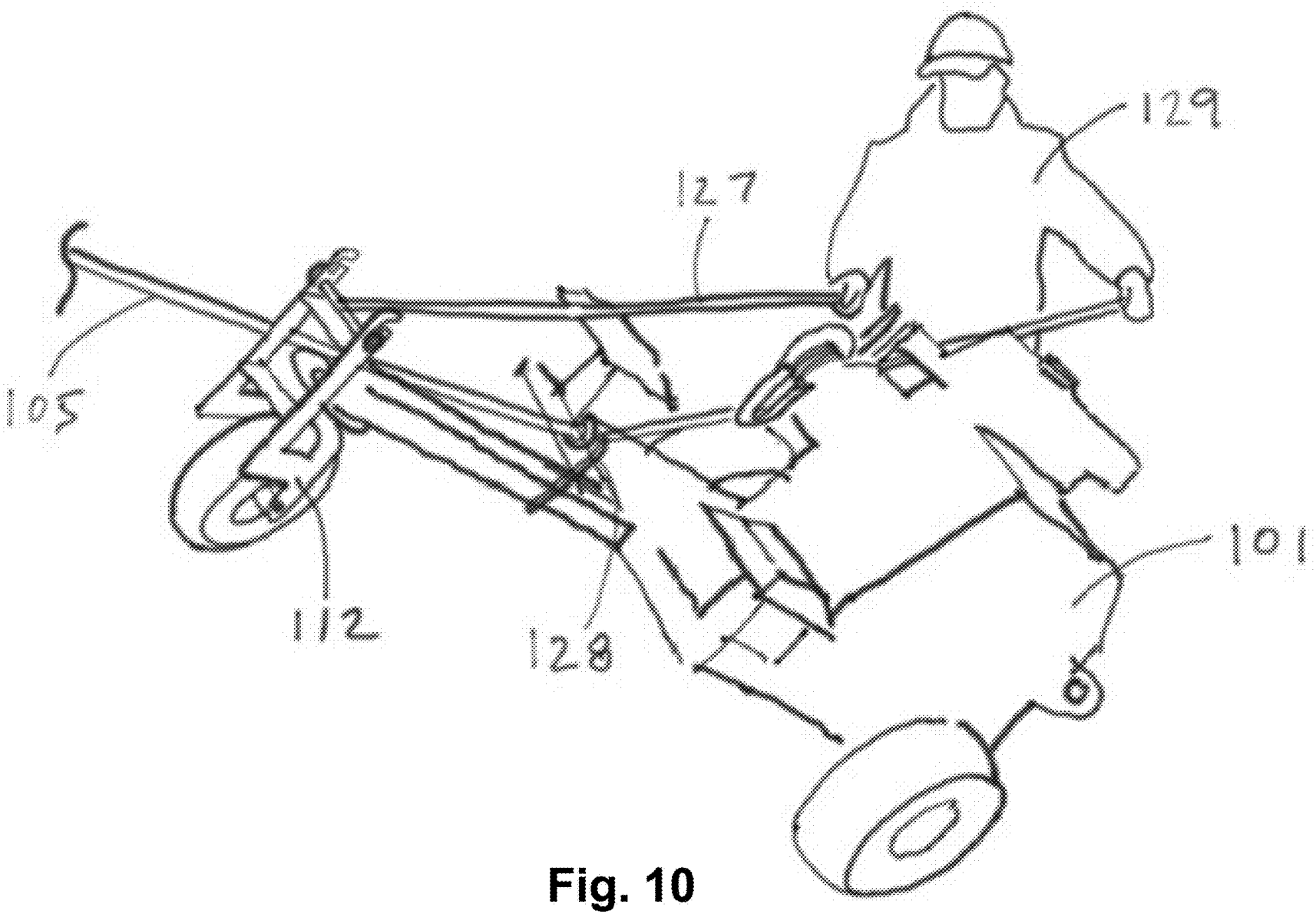
FIG. 10 illustrates a configuration for using the powered capstan to drive and steer the trailer up a hill or incline.

The steerable front wheel 112 allows the portable winch system 101 to ascend, descend, and traverse essentially any terrain. FIG. 10 illustrates the portable winch system 101 ascending a hill or steep terrain. The rope 105 is attached to a fixed object, like a tree, up the hill and in a general direction of desired travel. The steerable front wheel 112 is snapped into the trailer hitch 124. The rope 105 may be threaded through a rope guide 128 to allow an operator 129 to easily manage the rope 105. The rope guide 128 may be a spring shaped rod that allows the rope 105 to be quickly inserted without requiring an end of the rope 105 to be threaded through the rope guide 128. The rope 105 may then be wrapped around the capstan 108 a plurality of times (e.g., 2 or 3 times) to create sufficient friction between the capstan 108 and the rope 105. The tail end 105*b* of the rope 105 may then be tensioned by the operator 129 to induce sufficient friction to pull the portable winch system 101 up the hill or incline. The operator 129 is holding the rope 105 in one hand and the steering handle 127 in the other hand. With the engine 103 started, the operator 129 can use the capstan 108 to power and move the portable winch system 101 up the hill without any traction requirements. In addition, because the front wheel 112 is steerable, the portable winch system 101 can be steered quite substantially away from the direct line of the rope 105, which allows the portable winch system 101 to be easily steered around any obstacle.

Figure 11:
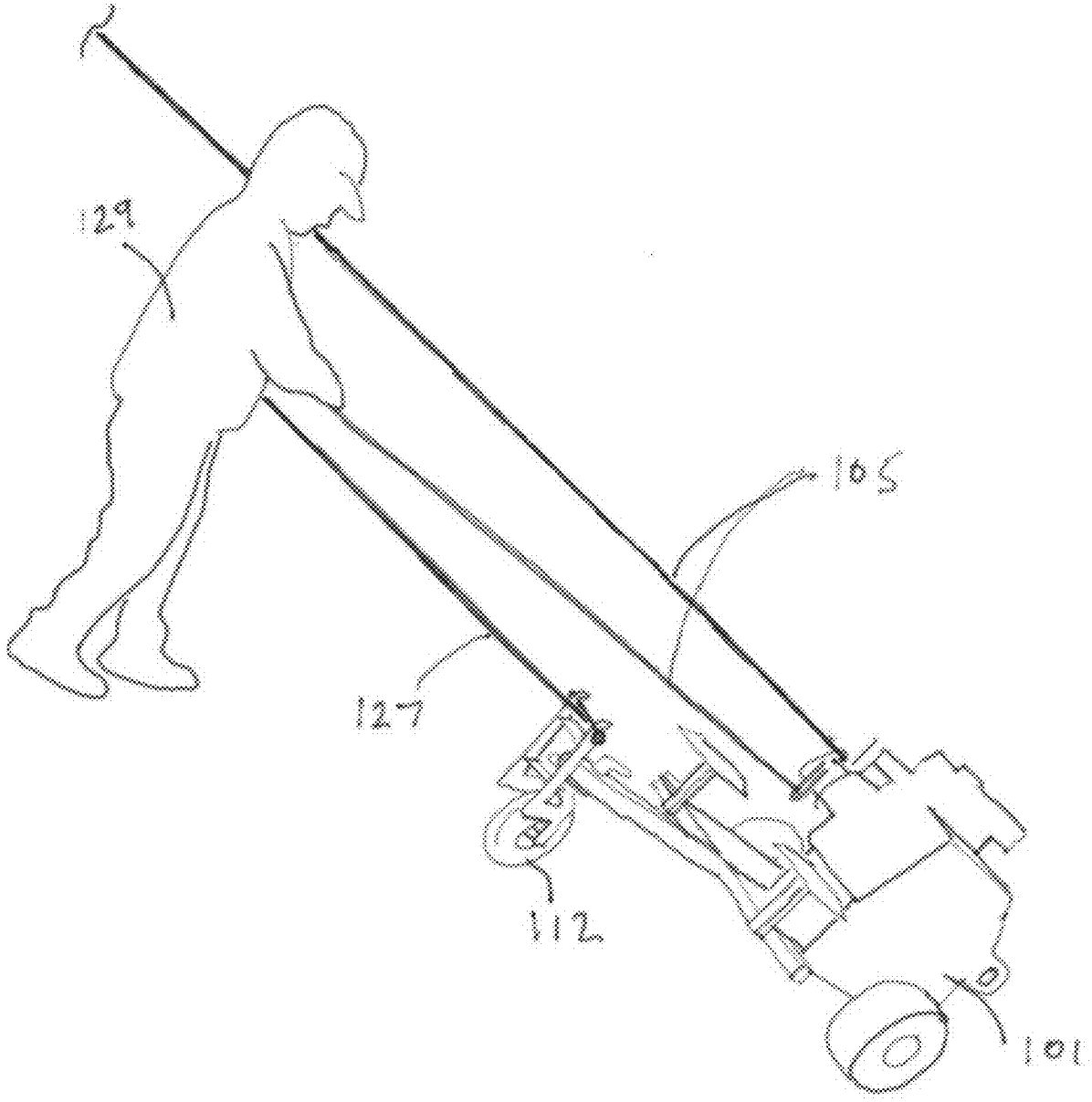
FIG. 11 illustrates a configuration for using the capstan as a friction element for steering and descending a hill or decline.

FIG. 11 illustrates an example of the portable winch system 101 descending a hill or steep terrain. In descending a hill, the engine 103 is not required because friction is all that is required to enable the portable winch system 101 to be lowered gently lowered down the hill. This may be achieved by wrapping the rope 105 around the capstan. To manage the weight of the portable winch system 101, tension on the rope 105 is slowly released. The steerable front wheel 112 and the steering handle 127 are used to direct the descent of the portable winch system 101. The rope 105 is anchored to a secure object uphill of the portable winch system 101, such as a tree, rock, etc. A rope guide, such as guide 128, may be used to aid in management of the rope 105 if desired. As the operator 129 releases tension on the rope 105, the portable winch system 101 will descend the hill due to gravity in the direction the operator 129 steers the wheel 127. The descent will generally follow a direction of the rope 105, although the steerable front wheel 127 allows the portable winch system 101 to be easily steered or maneuvered around various objects.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A portable winch system for pulling various objects, the portable winch system comprising:

a frame or base upon which one or more components are fixedly secured;

a pair of wheels that are attached to a bottom end of the frame or base to allow the winch to be transported between locations;

a hitch or attachment member that is attachable to a vehicle to allow the winch to be transported between said locations;

a motor that is fixedly secured to the frame or base;

a capstan or drum that is rotatably secured to the frame or base and that is operably coupled with the motor so that the capstan or drum is rotatable via the motor;

a rope or cord that is wound about the capstan or drum multiple times, the rope or cord having a tow end that extends from the capstan or drum in a first direction and a tail end that extends from the capstan or drum in a second direction, the tow end being attachable to an object to be pulled by the portable winch system and the tail end being graspable by a user to induce friction between the capstan or drum and the section of the rope or cord that is wound about the capstan or drum;

an input line guide that is fixedly secured to the frame or base and that is positioned adjacent the capstan or drum, the input line guide being configured to slidably receive the tow end of the rope or cord and to direct the tow end of the rope or cord toward the capstan or drum so that the tow end of the rope or cord is wound about the capstan or drum as the object is pulled toward the winch;

an alignment guide that is fixedly secured to the frame or base and that is positioned radially outward of an outer surface of the capstan or drum, the alignment guide being configured to contact the rope or cord and to align the rope or cord about the capstan or drum and thereby create a space for the tow end of the rope or cord as the tow end of the rope or cord is wound about the capstan or drum from the input line guide; and an output line guide that is fixedly secured to the frame or base and that is positioned adjacent the capstan or drum, the output line guide being configured to slidably receive the tail end of the rope or guide and to direct the tail end of the rope or cord from the capstan or drum so that the user may grasp the tail end of the rope or cord and induce said friction between the capstan or drum and the section of the rope or cord that is wound about the capstan or drum.

2. The portable winch system of claim 1, further comprising a gear mechanism that is attached to the motor and to the capstan or drum, the gear mechanism being configured to reduce a rotational speed of the motor so that a rotation speed of the capstan is about 60 feet per minute (FPM).

3. The portable winch system of claim 1, wherein the input line guide, the alignment guide, and the output line guide are open ended so that the rope or cord may be positioned within each guide while the tow end of the rope or cord is attached to an object to be pulled and while the tail end is grasped by the user.

4. The portable winch system of claim 1, wherein the alignment guide is a roller bearing.

5. The portable winch system of claim 1, wherein the portable winch system further comprises one or more of the following switches:

a user switch having a first end that is attached to the portable winch system and a second end that is attached to the user, the user switch being configured so that detachment of the user switch from the portable winch system causes the motor to shut off;

a remote switch that is wirelessly coupled with a processing unit of the portable winch, the remote switch being configured to shut off the motor in response to a signal communicated from the remote switch to the processing unit; and a tow end switch that is configured to automatically shut off the motor if a distal end of the tow end of the rope or cord becomes sufficiently close to the frame or base.

6. The portable winch system of claim 5, wherein the tow end switch comprises a slide member that is slidably attached to the tow end of the rope or cord and that is configured to engage a stop component of the tow end of the rope or cord as the distal end of the tow end of the rope or cord becomes sufficiently close to the frame or base, wherein engagement of the slide member and the stop component causes the slide member to move toward the frame or base and thereby automatically shut off the motor.

7. The portable winch system of claim 1, further comprising one or more feet that support a front portion of the portable winch, the one or more feet comprising a slide plate that engages the ground and that distributes a weight of the front portion of the portable winch system about the ground such that the front portion of the portable winch system is pivotable or slideable atop the ground in response to a tension in the tow end of the rope or cord, wherein pivoting or sliding of the front portion of the portable winch system aligns the portable winch system with the object being pulled.

8. The portable winch system of claim 7, wherein the one or more feet are detachable from the frame or base and wherein the frame or base includes a compartment that engages the one or more feet to enable the one or more feet to be stowed during transport of the portable winch.

9. The portable winch system of claim 1, further comprising a steerable front wheel that is removably coupleable with the hitch or attachment member so that the steerable front wheel is rotatable about an axis of the hitch or attachment member, the steerable front wheel being configured to guide or direct the portable winch system when the portable winch system is being transported and is detached from the vehicle.

10. The portable winch system of claim 9, further comprising a steering component that is removably coupleable with the steerable front wheel and that is graspable by a user to steer the steerable front wheel during said transport while the portable winch system is detached from the vehicle.

11. The portable winch system of claim 1, wherein the input line guide and the alignment guide are disposed on a distal end of a support member that extends over a portion of the capstan or drum, the support member having a proximal end that is fixedly secured to the frame or base of the portable winch.

12. The portable winch system of claim 1, further comprising an anchor member that is attachable to an anchoring rope, chain, or cord in order to anchor the portable winch system to a secure object.

13. The portable winch system of claim 1, wherein the input line guide and the output line guide are both U-shaped components within which the rope or cord is removably positionable.

14. A portable winch system comprising:

a frame or base;

a pair of wheels that are attached to a bottom end of the frame to allow the winch to be transported between locations;

a motor that is fixedly secured to the frame or base;

a capstan or drum that is rotatably secured to the frame or base and that is operably coupled with the motor so that the capstan or drum is rotatable via the motor;

a rope or cord that is wound about the capstan or drum multiple times, the rope or cord having a tow end that extends from the capstan or drum in a first direction and a tail end that extends from the capstan or drum in a second direction, the tow end being attachable to an object to be pulled by the portable winch system and the tail end being graspable by a user to induce friction between the capstan or drum and the section of the rope or cord that is wound about the capstan or drum;

an input line guide that is fixedly secured to the frame or base and that is positioned adjacent the capstan or drum, the input line guide being configured to slidably receive the tow end of the rope or cord and to direct the tow end of the rope or cord toward the capstan or drum so that the tow end of the rope or cord is wound about the capstan or drum as the object is pulled toward the winch; and an alignment guide that is fixedly secured to the frame or base and that is configured to contact the rope or cord and to align the rope or cord about the capstan or drum and thereby allow the rope or cord to be would about the capstan or drum in a defined manner an output line guide that is fixedly secured to the frame or base and that is positioned adjacent the capstan or drum, the output line guide being configured to slidably receive the tail end of the rope or guide and to direct the tail end of the rope or cord from the capstan or drum so that the user may grasp the tail end of the rope or cord and induce said friction between the capstan or drum and the section of the rope or cord that is wound about the capstan or drum.

15. The portable winch system of claim 14, wherein the input line guide, the alignment guide, and the output line guide are open ended so that the rope or cord may be positioned within each guide while the tow end of the rope or cord is attached to an object to be pulled and while the tail end is grasped by the user.

16. The portable winch system of claim 14, wherein the alignment guide comprises a roller bearing, a plain bearing, a cam follower bearing, a needle bearing, or a ball bearing.

17. The portable winch system of claim 14, wherein the portable winch system further comprises one or more of the following switches:

a user switch having a first end that is attached to the portable winch system and a second end that is attached to the user, the user switch being configured so that detachment of the user switch from the portable winch system causes the motor to shut off;

a remote switch that is wirelessly coupled with a processing unit of the portable winch, the remote switch being configured to shut off the motor in response to a signal communicated from the remote switch to the processing unit; and a tow end switch that is configured to automatically shut off the motor if a distal end of the tow end of the rope or cord becomes sufficiently close to the frame or base.

18. The portable winch system of claim 14, further comprising one or more feet that support a front portion of the portable winch, the one or more feet comprising a slide plate that engages the ground and that distributes a weight of the front portion of the portable winch system about the ground such that the front portion of the portable winch system is pivotable or slideable atop the ground in response to a tension in the tow end of the rope or cord, wherein pivoting or sliding of the front portion of the portable winch system aligns the portable winch system with the object being pulled.

19. The portable winch system of claim 14, further comprising a steerable front wheel that is removably coupleable with a front portion of the frame or base, the steerable front wheel being configured to guide or direct the portable winch system when the portable winch system is being transported between locations.

* * * * *